US009441373B1

(12) United States Patent
Header

(10) Patent No.: US 9,441,373 B1
(45) Date of Patent: Sep. 13, 2016

(54) GLUE LAMINATED TIMBER

(71) Applicant: Gregory Header, Richland, PA (US)

(72) Inventor: Gregory Header, Richland, PA (US)

( * ) Notice: Subject to any disclaimer, the term of this patent is extended or adjusted under 35 U.S.C. 154(b) by 0 days.

(21) Appl. No.: 14/797,869

(22) Filed: Jul. 13, 2015

(51) Int. Cl.
*B27M 3/00* (2006.01)
*E04C 3/12* (2006.01)
*E04C 3/14* (2006.01)

(52) U.S. Cl.
CPC ..... *E04C 3/122* (2013.01); *B27M 3/0053* (2013.01); *E04C 3/125* (2013.01); *E04C 3/14* (2013.01); *E04B 2103/04* (2013.01)

(58) Field of Classification Search
CPC ..... E04C 3/122; E04C 3/125; E04C 3/14; E04B 2103/04; B27M 3/0026; B27M 3/0066; B27M 3/0053
See application file for complete search history.

(56) References Cited

U.S. PATENT DOCUMENTS

| | | | | | |
|---|---|---|---|---|---|
| 183,042 | A | * | 10/1876 | Cummings | B27M 3/0053 52/591.2 |
| 1,409,410 | A | | 3/1922 | Rockwell | |
| 1,799,958 | A | * | 4/1931 | Cranston | B27M 3/0066 144/24.02 |
| 3,094,747 | A | | 6/1963 | Hess | |
| 3,167,823 | A | * | 2/1965 | Palfey | E06B 3/62 264/261 |
| 3,445,325 | A | * | 5/1969 | Clark | B32B 21/13 428/119 |
| 4,394,409 | A | | 7/1983 | Hertel | |
| 4,741,144 | A | | 5/1988 | Graffin | |
| 5,976,644 | A | * | 11/1999 | Sanaee | B27J 1/003 144/333 |
| 6,164,027 | A | | 12/2000 | Ohlund | |
| 7,997,044 | B2 | | 8/2011 | Green et al. | |
| 8,863,467 | B1 | | 10/2014 | Steinberg | |
| 2001/0032683 | A1 | * | 10/2001 | Hill | B27D 1/04 144/353 |
| 2004/0103613 | A1 | * | 6/2004 | Salzsauler | E01D 19/125 52/676 |
| 2004/0134589 | A1 | * | 7/2004 | Hill | B27D 1/00 156/100 |
| 2010/0275551 | A1 | | 11/2010 | Hofmann | |

FOREIGN PATENT DOCUMENTS

| | | | |
|---|---|---|---|
| CN | 201881444 | U | 6/2011 |
| CN | 203471890 | U | 3/2014 |
| CN | 104210013 | A | 12/2014 |
| DE | 102006031338 | A | 1/2007 |
| FR | 2770865 | A1 | 11/1997 |
| FR | 2812317 | A1 | 2/2002 |

(Continued)

OTHER PUBLICATIONS

Laminated Beams, Feb. 2012, Timbory, Hass Holzprodukte GmbH, Falkenberg, Germany.

(Continued)

*Primary Examiner* — Elizabeth A Quast
(74) *Attorney, Agent, or Firm* — Stone Creek Services LLC; Alan M Flum

(57) ABSTRACT

Disclosed is a novel glue laminated timber, or glulam, that simulates the appearance of solid sawn wood. The glulam can be utilized as both a structural and aesthetic element for glass doors and windows as well as other structural applications where appearance might be a consideration. It can also be utilized in furniture making and wood working applications where thick solid furniture-grade exotic hardwood can be utilized and can be difficult to obtain. The lams are stacked along the length of the glulam providing a solid wood outer surface as the widest surface of the glulam. At least one lam is stacked transversely and inset from opposing longitudinal edges to form the appearance of a solid wood surface and cover lamination seams.

18 Claims, 11 Drawing Sheets

(56) References Cited

FOREIGN PATENT DOCUMENTS

| | | | |
|---|---|---|---|
| JP | 11019905 | A | 1/1999 |
| JP | 2002192596 | A | 7/2002 |

OTHER PUBLICATIONS

Oakmasters Catalog, Jun. 2006, Oakmasters, West Sussex, Great Britain.
Fraiser Wood Edge Matched Glulam, Sep. 2014, Fraser Wood Industries, Squamish, BC, Canada.
Beam Cladding, Distinctive Wood Designs, Inc., Delta, BC, Canada, accessed on the Internet at http://www.distinctivewood-designs.com/beam_cladding.php on Apr. 9, 2015.
Fraiser Wood Grain Matched Glulam, Sep. 2014, Fraser Wood Industries, Squamish, BC, Canada.
Faiser Wood Power Column, Apr. 2012, Fraser Wood Industries, Squamish, BC, Canada.
AITC 113-2010 Standard for Dimensions of Structural Glue Laminated Timber, Sep. 2010, American Institute of Timber Construction, Centennial Colorado US.
AITC 119-96 Standard Specifications for Structural Glue Laminated Timber of Hardwood Species, Mar. 1996, American Institute of Timber Construction, Centennial Colorado US.
ANSI A190.1-2012 Standard for Wood Products—Structural Glue Laminated Timber, Form No. ANSI A190.1-2012, Jan. 2013, APA—The Engineered Wood Association, Tacoma, WA US.
ANSI 117-2010 Standard Specification for Structural Glue Laminated Timber of Softwood Species, Form No. ANSI 117-2010, Mar. 2013, APA—The Engineered Wood Association, Tacoma, WA US.
Common Misconceptions About Glulam Beams, Form No. Q710A, Mar. 2015, APA—The Engineered Wood Association, Tacoma, WA US.
Glulam Product Guide, Form No. X440D, Dec. 2008, APA—The Engineered Wood Association, Tacoma, WA US.
Glulam Design Specification, Form No. Y117E, Aug. 2008, APA—The Engineered Wood Association, Tacoma, WA US.
Design of Structural Glued Laminated Timber Columns, Form No. EWS Y240C, Aug. 2009, APA—The Engineered Wood Association, Tacoma, WA US.

* cited by examiner

GLUE LAMINATED TIMBER

BACKGROUND

The present disclosure relates to an apparatus, methods, and articles of manufacture for the building construction trade and can also be applied to wood working or furniture making Specifically the application relates to Glue laminated timbers or glulams.

A glulam is a solid structural wood timber that is constructed from two or more layers of dimensional lumber (i.e. lumber that is cut and kiln dried to standardized width and depths) that are bonded together with a moisture-resistant structural adhesive. The dimensional lumber members, or lams, are constructed so that the grain runs parallel to the length of the members.

Glulams offer advantages over large solid-sawn wood timbers. Glulams tend to have better dimensional stability than a solid-sawn wood timber. Larger solid-sawn wood timbers tend to go through dimensional changes as they dry. Glulams are made from smaller dimensional lumber that has already been dried, and therefore are dimensionally stable, before assembly into the finished Glulam. Glulams typically cost less than equivalent sized solid-sawn timbers because they are constructed from standard dimensional lumber.

Glulams have a distinctive visual appearance on the ends and two of the four sides and ends because the Glulam timbers are made from stacked dimensional lumber with different grain patterns. While this can often create a striking visual effect, it is not always desirable.

SUMMARY

The present disclosure describes a glulam that has the potential to mimic the appearance of solid-sawn timbers. In conventional glulams the lams are stacked perpendicular to the length of the glulam. In aspects of the present disclosure, the lams are stacked along the length of the glulam. This creates a solid wood surface that runs along the length of the glulam that is wider than the corresponding adjacent surfaces that have exposed lamination seams. An inset is cut into either one or both of the corresponding adjacent surfaces with the exposed lamination seams. The inset includes bevels that extend or draft inward from the opposing longitudinal edges of the surface. A solid wood cap with substantially the same length and width as the inset surface is beveled with a complementary shaped so the wood cap and inset surface can be glue laminated together with any gaps, or seams.

It may be desirable to make one or both of the ends of the glulam have the appearance of solid wood. One or both of the ends can be inset by a manner similar as described above. The outer face of the end cap runs edge-to-edge along the perimeter of the ends. The end cap can be fabricated by cutting across a length of dimensional lumber. This will give a grain pattern consistent with the end portion of a solid beam.

In another aspect, the above-described glulam can be used as part of a structural frame for a door, window, skylight, sun room, sloped glazing, or curtain wall where the appearance of solid wood is desirable. In these applications, one of the longitudinal sides with exposed lamination seams may not need to be covered. For example, the glulam may be used in a window or window wall where the glass panel, or glazing panel, is inset into a groove in the glulam on one of the sides where the lamination seams are visible. The side opposite of this would have the longitudinal beveled inset and corresponding longitudinal solid wood cap. The solid wood cap has a complementary shape to the inset and corresponding bevels tapering from along the longitudinal edges so that the longitudinal solid wood cap and inset join at a corner edge and appear to be seamless. In this instance, depending on the number of lams and thickness of the laminations, the lamination seams may be completely or partially obscured by the glass panel and its mounting structure. The other three exposed sides would have the appearance of a solid wood beam.

In another example, the glulam may be used in a similar application where the glass panel is secured to the glulam frame member by rigid removable glazing stops. In this example, the exposed laminations facing the glass panel would be obscured by the removable glazing stops or the glazing stop assembly. The opposite side would include the inset bevel and corresponding longitudinal solid wood cap, as described above. In a third example, the glulam could be used as a mullion in a curtain wall structure. In this example, the exposed laminations would face outward and parallel to the glass panels but would be covered by the pressure bar mounting assembly. The opposite end, which faces directly into the interior environment, would be covered with a longitudinal solid wood cap as described in the last two examples.

In another example, the glulam can be used in woodworking or furniture making. It is often difficult to procure furniture grade wood in certain species, such as red wood or cypress in thickness over 8/4 (0.051 m). Often, it is difficult or cost prohibitive to get furniture grade exotic hard woods such as, east Indian rose wood, purple heart, poculi, or zebrawood, in thicknesses over 4/4 (0.025 m). The glulam of the present disclosure can allow the furniture maker or carpenter to realize greater thickness of furniture grade dimensioned lumber than normally practical as well as providing for increased dimensional stability which limits warping.

The combination of lams as described, and longitudinal solid wood caps, give the glulam effectively a lam layup of two or more lams oriented along the length of the glulam and one to two lams oriented transverse to the length. The inventor found, during stress testing, that this had an unexpected benefit of superior strength characteristics as compared with a conventional glulam made of the same material.

This Summary introduces a selection of concepts in simplified form that are described the Description. The Summary is not intended to identify essential features or limit the scope of the claimed subject matter.

DRAWINGS

DESCRIPTION

Figure 1:
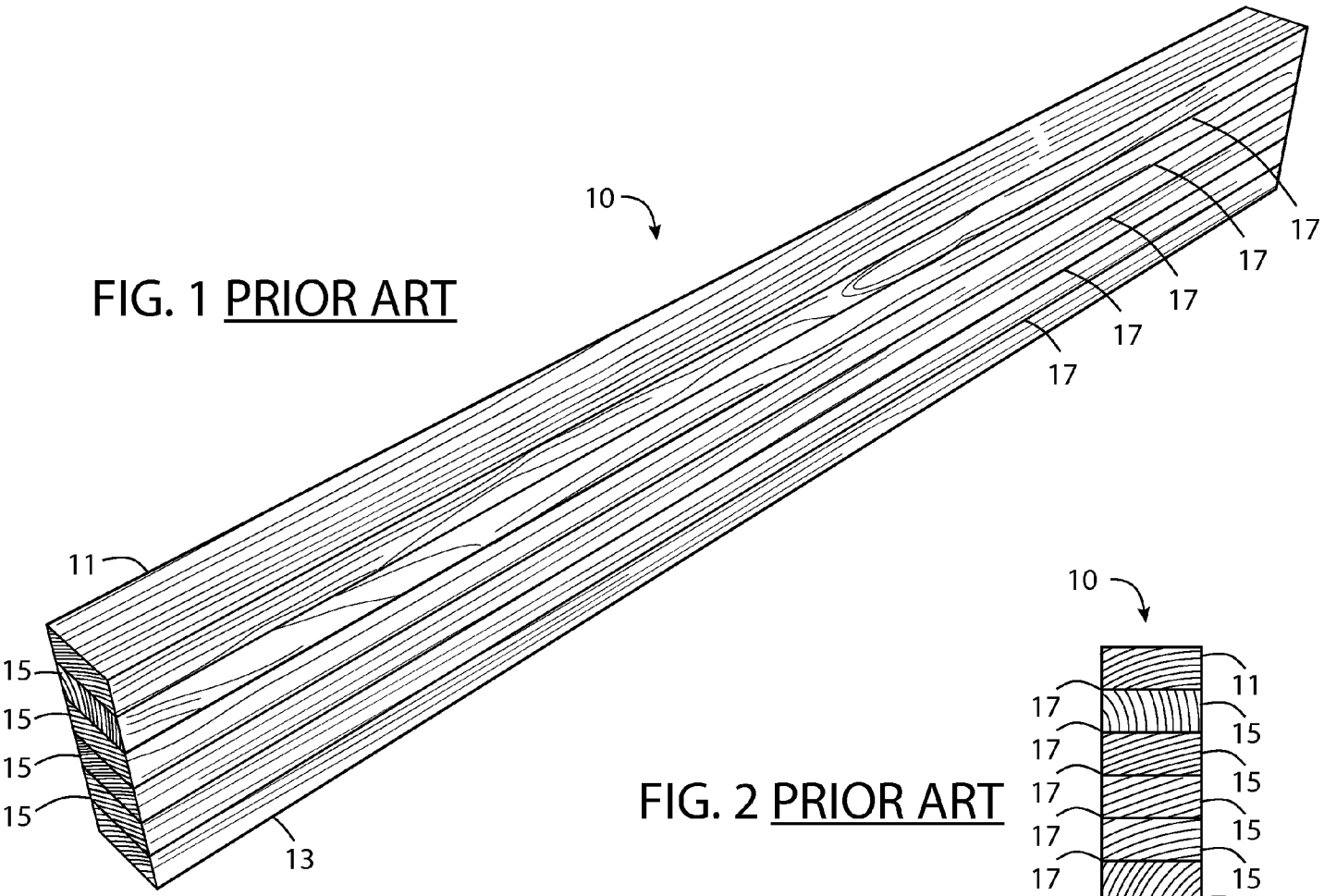
FIG. 1 PRIOR ART
FIG. 1 illustrates a top and front perspective view of a typical glue-laminated timber in the prior art.

Through this disclosure, the terms "left", "right", "top", "bottom", "front", and "back" are relative terms used for the convenience of the reader when referring to relative orientations in the drawings. They do not imply an absolute direction or orientation and in no way should be interpreted as a limitation on the claims. When referring to dimensions throughout this disclosure, the term "substantially the same" is understood to mean dimensions being the same to within normal tolerances that would be recognized by one skilled in the art for glulam construction, building construction, or carpentry work, depending on the application.

Figure 2:
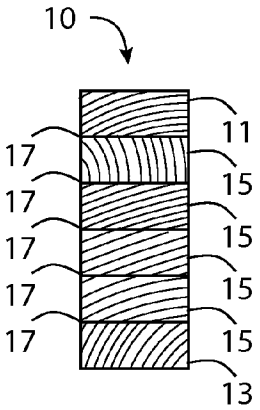
FIG. 2 PRIOR ART
FIG. 2 illustrates an end view of the glue-laminated timber of FIG. 1.

The following description is made with reference to figures, where like numerals refer to like elements throughout the several views. FIG. 1 illustrates a top and front perspective view of a glulam 10 typical in the prior art. FIG. 2 illustrates an end view of the glulam 10 of FIG. 1. The glulam is constructed from lengths of stacked pieces of dimensional lumber or "lams." The lams are bonded together with wood bonding adhesives. The specific stacking arrangement of the lams is known to one skilled in the art as the "beam layup." FIGS. 1 and 2 illustrate what is known in the art of making glulam timbers as a standard beam layout. There are three types of lams illustrated: a compression lam 11 positioned on the top of the glulam, a tension lam 13 positioned at the bottom of the glulam, and core lams 15 positioned between the compression lam 11 and the tension lam 13. The compression lam 11, the tension lam 13, and the core lams 15 are stacked horizontally with each lam having a width greater than their height. Typically, the compression lam 11, the tension lam 13, and the core lams 15 are typically 1⅜ inches (0.0349 meters) to 1½ inches (0.0381 meters) high and 2½ inches (0.0635 meters) to 10¼ inches (0.260 meters) wide depending on the type of wood used. The use of compression lams 11 and tension lams 13 that have different load bearing characteristics than the core lams 15 allows for a variety of load bearing applications. The design of typical glulam used is dictated by construction industry standards such as ANSI/AITC Standard A190.1 for Structural Glue Laminated Timber. Lamination seams 17 run along the front and back length of the glulam as well as the right and left ends.

Figure 3:
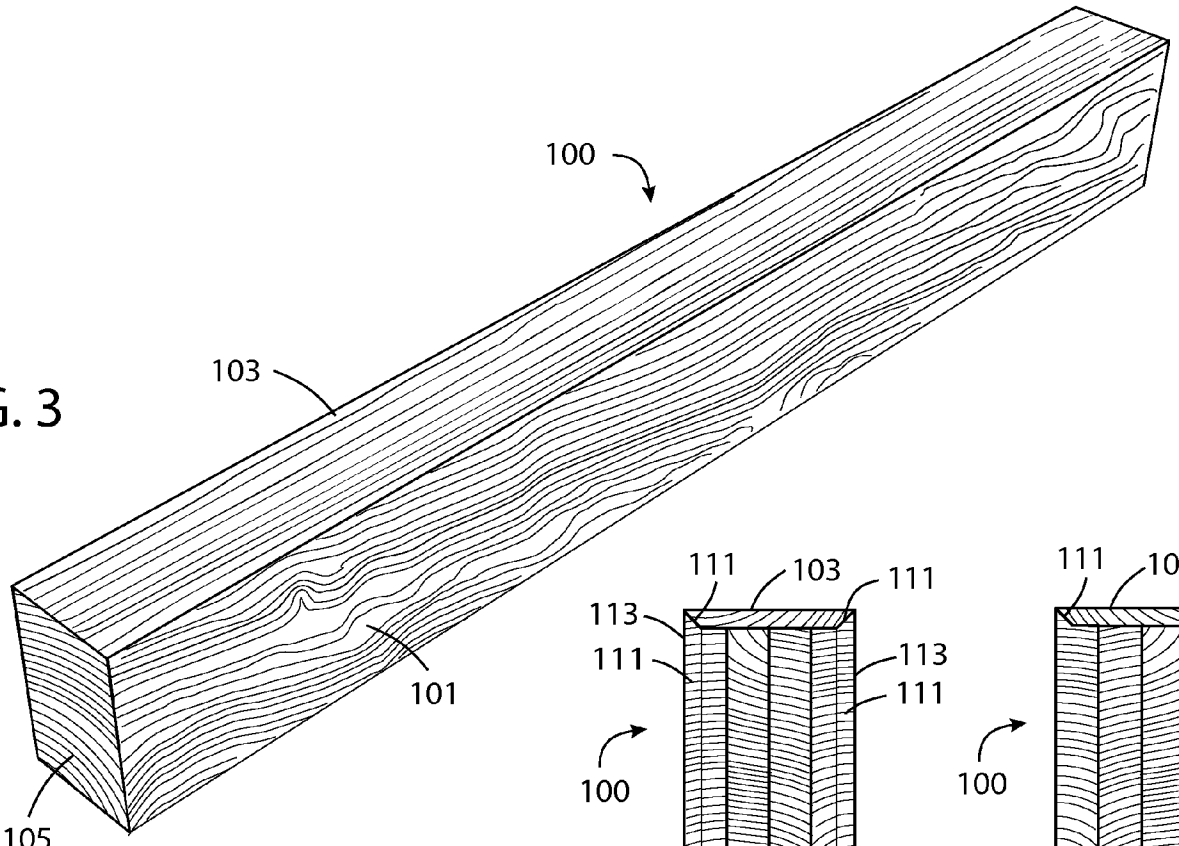
FIG. 3 illustrates a top and front perspective view of a glue-laminated timber of the present disclosure.

FIG. 3 illustrates a top and front perspective view of a glulam 100 of the present disclosure that covers the lamination seams 17 of FIGS. 1-2 on two sides of the four sides that have lamination seams. Although the faces shown in the figure mimic the appearance of a single piece of solid-sawn timber, the frontward most facing surface in the figure is actually the outside surface of a first outer lam 101. The top surface of the figure is a solid wood longitudinal cap 103. The length of the solid wood longitudinal cap 103 runs the edge-to-edge length of glulam 100. The width of the solid wood longitudinal cap 103 runs edge-to-edge width of the glulam 100. The left end of the glulam 100, as illustrated in the figure, includes a solid wood end cap 105 with an outer surface that runs edge-to-edge along the end surface of the glulam 100. The solid wood end cap 105 illustrated in FIG. 3 was produced by cutting across a length of dimensional lumber. This gives the appearance of end grain.

The glulams 100 of the present disclosure can be used to cover lamination seams on all or some of the seamed surfaces. Some applications do not require all laminations seams be covered. For example, glass doors may have the end laminations hidden from view and have one end seam obscured by the mounting structure of the glass panel. This will be described in greater detail later in this disclosure. The glulam 100 of FIG. 3 leaves two faces with exposed seams; the bottom and the right end surfaces of the figure.

Figure 4:
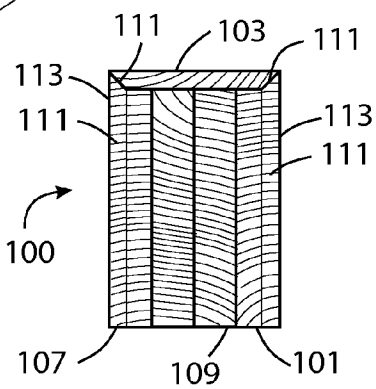
FIG. 4 illustrates a left end view of the glue-laminated timber of FIG. 3 with the end cap removed for clarity.
Figure 5:
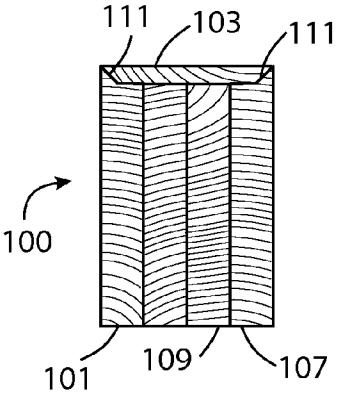
FIG. 5 illustrates a right end view of the glue-laminated timber of FIG. 3.

FIG. 4 illustrates a left end view of the glulam 100 of FIG. 3 with the end cap removed for clarity. FIG. 5 illustrates a right end view of the glue-laminated timber of FIG. 3. FIGS. 4 and 5 illustrate the first outer lam 101, a second outer lam 107, core lams 109, and the solid wood longitudinal cap 103. An inset is cut into the top of the first outer lam 101, the second outer lam 107, and the core lams 109. The inset includes bevels 111 that extend inward from the top longitudinal edges of the first outer lam 101 and the second outer lam 107. In FIG. 4, the first outer lam 101 and the second outer lam 107 are also inset to accept the solid wood end cap 105. They are beveled 111 inwardly along from their vertical edges 113.

Figure 6:
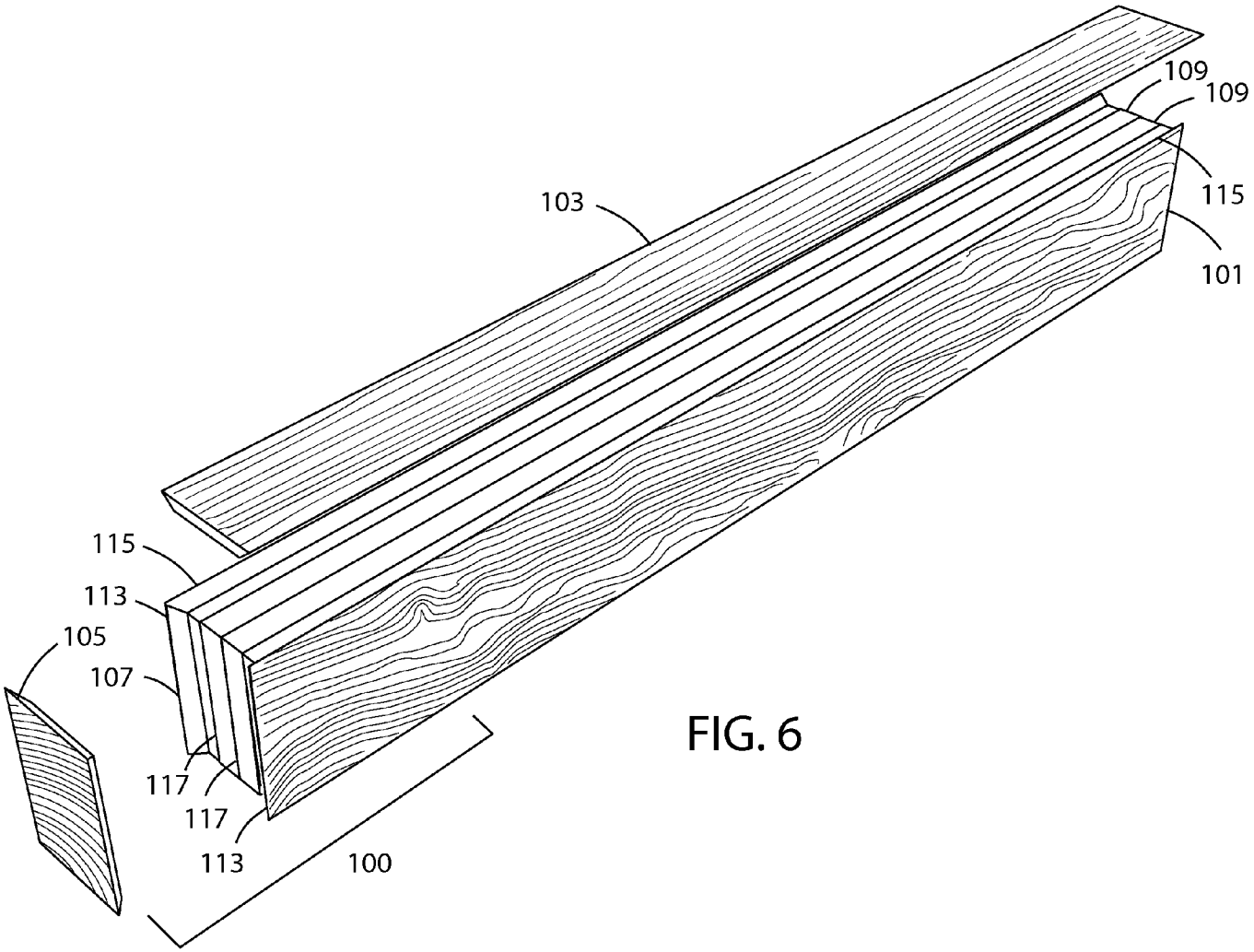
FIG. 6 illustrates an exploded perspective view of the glue-laminated timber of FIG. 3 showing the top cap and end caps exploded away for clarity.
Figure 7:
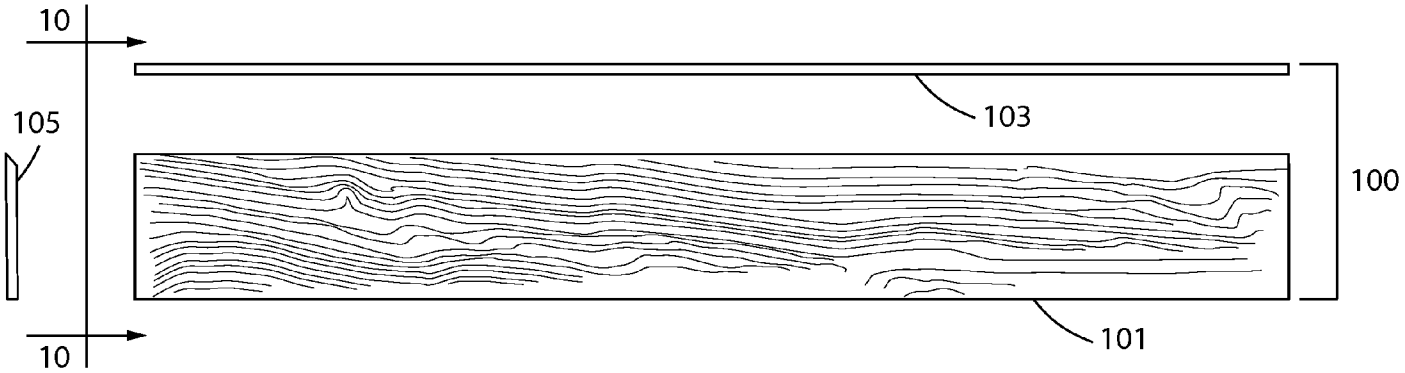
FIG. 7 illustrates a front exploded view of FIG. 3.
Figure 8:
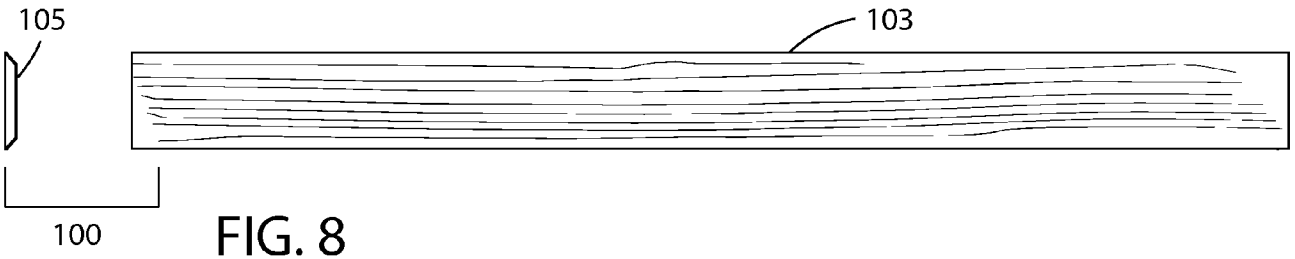
FIG. 8 illustrates a top exploded view of FIG. 3.
Figure 9:
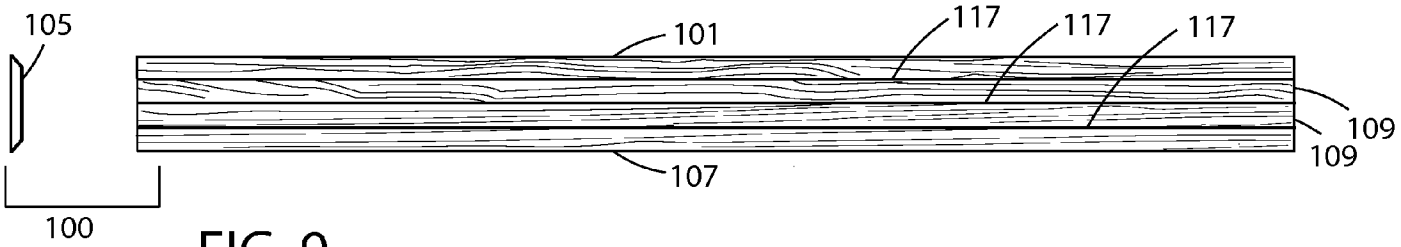
FIG. 9 illustrates a bottom exploded view of FIG. 3.
Figure 10:
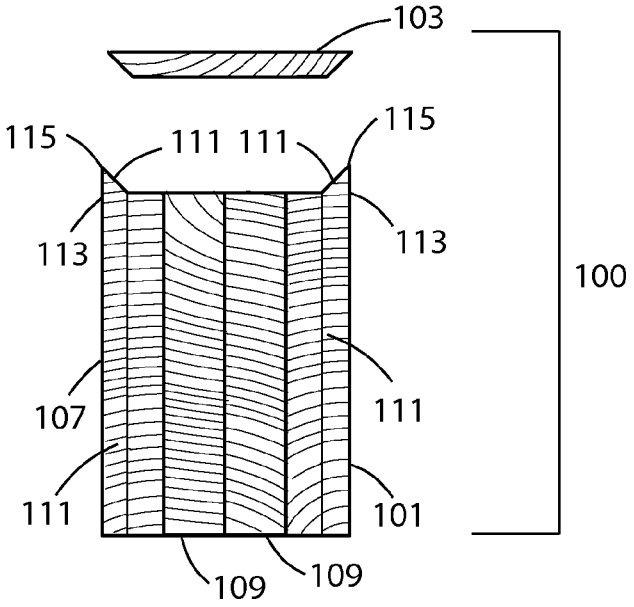
FIG. 10 illustrates a left end exploded view of FIG. 3 with the end cap moved out of view for clarity.
Figure 11:
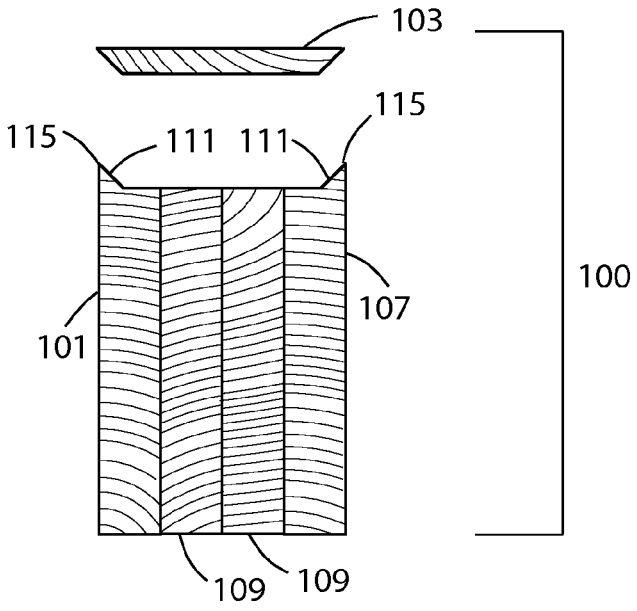
FIG. 11 illustrates a right end exploded view of FIG. 3.

FIG. 6 illustrates an exploded perspective view of the glulam 100 of FIG. 3 showing the solid wood longitudinal cap 103 and with the solid wood end cap exploded away for clarity. FIG. 7 illustrates a front exploded view of the glulam 100 of FIG. 6 showing a longitudinal grain pattern of the first outer lam 101, and side views of both the solid wood end cap 105 and the solid wood longitudinal caps 103. FIG. 8 illustrates a top exploded view of the glulam 100 of FIG. 3. FIG. 8 shows the longitudinal grain pattern of outside facing surface of the solid wood longitudinal cap 103. FIG. 8 shows a top view of the solid wood end cap 105. FIG. 9 illustrates bottom exploded view of the glulam 100 of FIG. 3 showing the solid wood end cap 105 exploded away. FIG. 10 illustrates left end exploded view of the glulam 100 of FIG. 3 with the end cap moved out of view for clarity. FIG. 11 illustrates a right end exploded view of the glulam 100 of FIG. 3.

FIGS. 6, 10, and 11 show the relationship between the solid wood longitudinal cap 103 and the sub-assembly of the first outer lam 101, the second outer lam 107, and the core lams 109. The relation shown between the lams or "layup" in FIGS. 6, 10, and 11 is very different than in FIGS. 1-2. In FIGS. 1-2, the compression lam 11, the tension lam 13, and the core lams 15 are stacked perpendicular to the length of the glulam 10. In FIGS. 6, 10, an 11, the first outer lam 101, the core lams 109, and second outer lam 107 are stacked along the length of the glulam 100. The stacking arrangement is taught away from in the art. For example, the construction industry standards such as ANSI/AITC Standard A190.1 for Structural Glue Laminated Timber specifically teach the stacking arrangement where the lams are stacked perpendicular to the length of the glulam 10 as in FIGS. 1-2. However, the stacking arrangement illustrated in FIG. 6, provide the glulam 100 with outer lams that represent a wider finished and non-seamed surface than the glulam 10 of FIGS. 1-2.

FIGS. 6, 10, and 11 illustrates the inset on the top surfaces of the first outer lam 101, the core lams 109, and the second outer lam 107. FIGS. 6 and 10 illustrate the bevels 111 that extend inward from the vertical edges 113 of both the first outer lam 101 and the second outer lam 107. FIGS. 6, 10, and 11 illustrate the bevels 111 that extend from the longitudinal edges 115 into the inset. The inset is complementary in shape to the bottom outline of the solid wood longitudinal cap 103. This allows the solid wood longitudinal cap 103 to seat in the inset and be glue laminated without any gaps.

Figure 12:
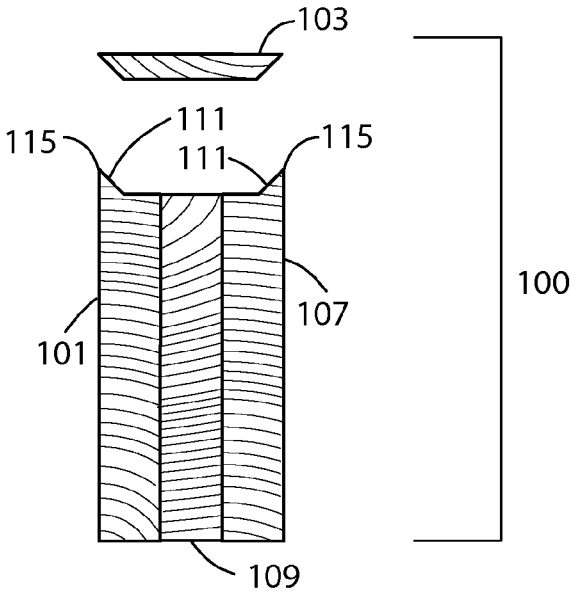
FIG. 12 illustrates a right end exploded view of an alternative glue-laminated timber of FIG. 3 illustrating a three-plank layup.
Figure 13:
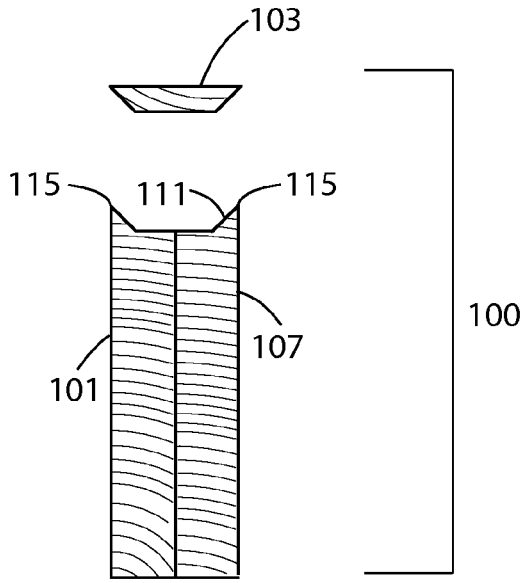
FIG. 13 illustrates right end exploded view of an alternative glue-laminated timber of FIG. 3 illustrating a two-plank layup.

FIGS. 3-11 illustrate a four-plank layout. FIG. 12 illustrates a right end exploded view of an alternative version of the glulam 100 of FIG. 3 illustrating a three-plank layup. FIG. 13 illustrates right end exploded view of an alternative version of the glulam 100 of FIG. 3 illustrating a two-plank layup. FIG. 12 illustrates the first outer lam 101, the second outer lam 107, and one of the core lams 109. FIG. 13 illustrates a glulam 100 with a first outer lam 101 laminated directed to the second outer lam 107. In FIG. 12 illustrates the inset on the top surfaces of the first outer lam 101, the core lams 109, and the second outer lam 107. FIG. 13 illustrates the inset on the top surfaces of the first outer lam 101 and the second outer lam 107. In both FIGS. 12-13, the inset includes a planar surface and bevels 111 that draft inward from the longitudinal edges 115, or longitudinal margins, of the first outer lam 101 and the second outer lam 107. The inset is complementary in shape to the bottom outline of the solid wood longitudinal cap 103. This allows the solid wood longitudinal cap 103 to seat in the inset and be glue laminated without any gaps and forms a seamless joint along the longitudinal edges 115 giving the glulam the appearance of solid saw cut wood on the combination of the surfaces of the first outer lam 101, the second outer lam 107, and the solid wood longitudinal cap 103.

There are applications that do not require that entire glulam have all of its outer faces hide the lamination seams. In FIG. 3, for example, the bottom surface and the right end of the glulam 100 of are not covered with the solid wood longitudinal cap 103 and a solid wood end cap 105 respectively. FIG. 9 shows the bottom surface of the glulam 100 of FIG. 3. In FIG. 9, the first outer lam 101, the core lams 109, the second outer lam 107, and the lamination seams 117 are visible.

Figure 14:
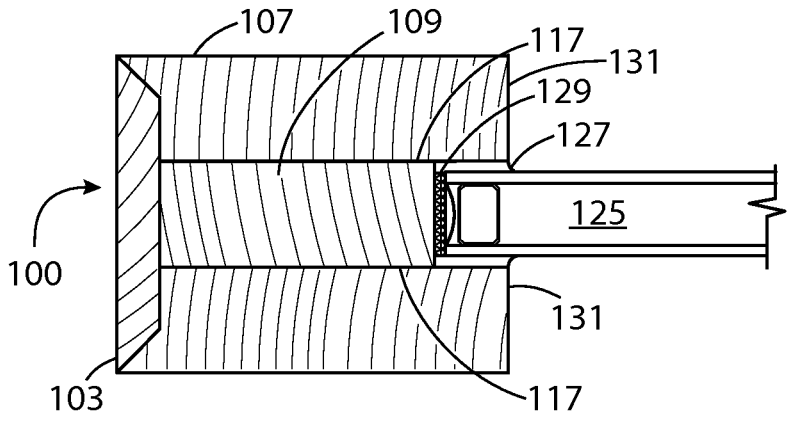
FIG. 14 illustrates a three-plank layup glulam similar to FIG. 3 used in a wood frame glass window or door that utilizes a modified marine glazing.
Figure 15:
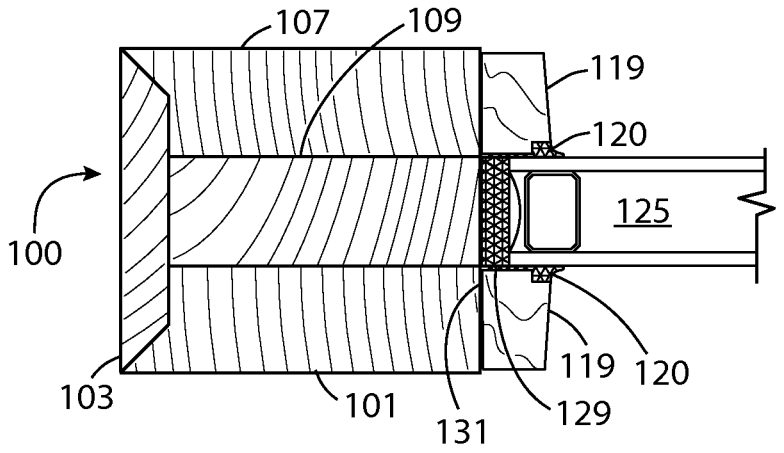
FIG. 15 illustrates a three-plank layup glulam similar to FIG. 3 used in a wood frame glass window or door that utilizes glazing stops.
Figure 16:
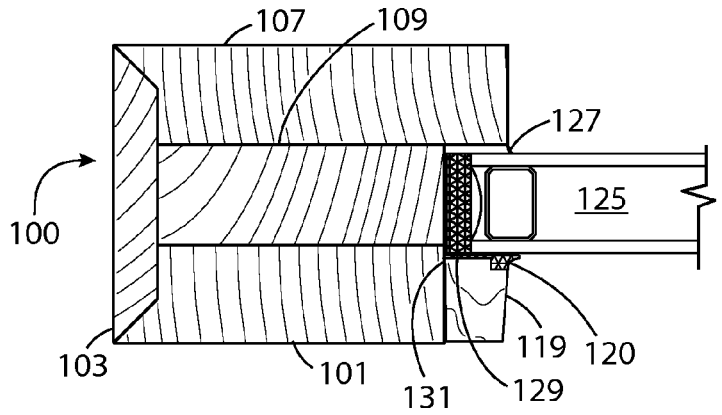
FIG. 16 illustrates a three-plank layup glulam similar to FIG. 3 used in a wood frame glass window or door that utilizes glazing stop on one side of the glass panel.
Figure 17:
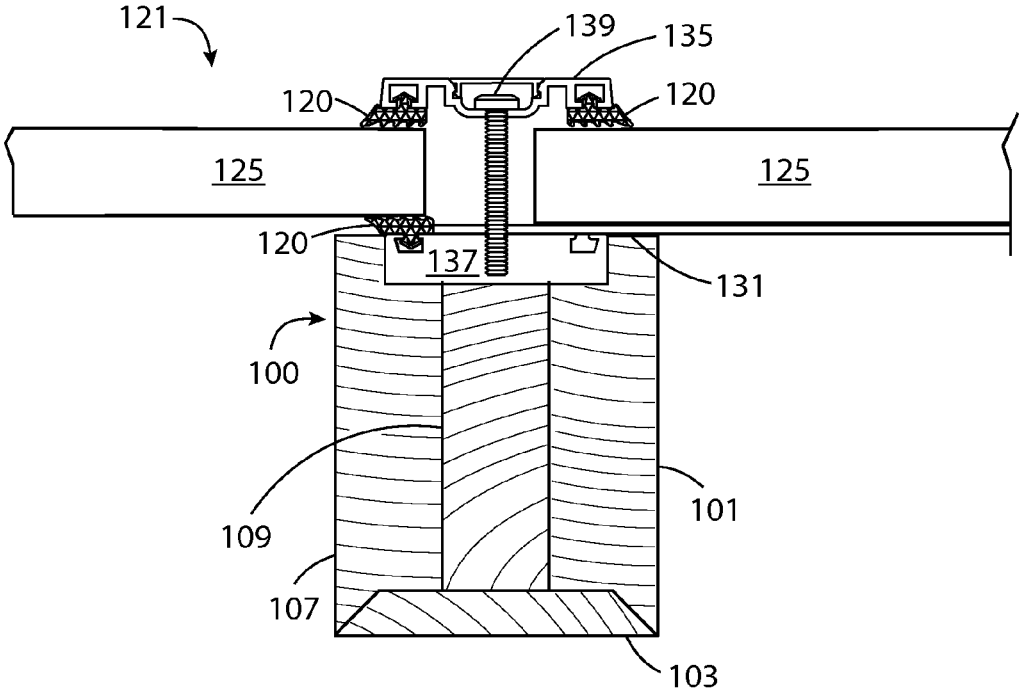
FIG. 17 illustrates a three-plank layout glulam similar to FIG. 3 used for the interior mullion in a curtain wall.

Several such applications are shown in FIGS. 14-17 in top plan view. FIG. 14 illustrates a glulam 100 used in a wood frame glass window or door utilizing a modified marine glazed system. A marine glazing utilizes a glazing gasket that wraps around the end of the glazing panel and holds it within a u-shaped channel. The modified marine glazing system of FIG. 14 utilizes a glazing sealant, such as silicone sealant or alternatively, structural silicone sealant, to hold the glazing panel in place while the panel end rests on setting blocks. FIG. 15 illustrates the glulam 100 in a mechanically glazed glass door or window system. In FIG. 15 the glulam utilizes a pair of removable glazing stops 119. FIG. 16 illustrates a combination of a mechanical and structurally glazed wood frame glass door or window. In FIG. 16 the glulam 100 utilizes a removable glazing stop 119 in combination with the second outer lam 107 to hold a glass panel 125 in place. FIG. 17 illustrates the glulam used in a curtain wall 121. The glulam 100 of FIGS. 14-17 utilizes a similar structure as the glulam 100 of FIGS. 3-11. The glulam 100 of FIGS. 14-17 have one of the core lams 109 like FIG. 12 instead of two core lams like FIGS. 3-11. The glulams 100 of FIGS. 14-17 each have the first outer lam 101, the second outer lam 107, the solid wood longitudinal cap 103, and the same inset structure as described for FIGS. 3-11. FIGS. 14-17 utilize the glulam 100 as part both the appearance and structure portion of the door or window structure.

In FIG. 14, a second solid wood longitudinal cap is not necessary because the glass panel 125 and its mounting structure, which includes a glass panel 125, glazing sealant 127, and setting blocks 129 obscure the lamination seams 117 on the second longitudinal surface 131. The glass panel 125, setting blocks 129, and glazing sealant 127 is inset into a groove cut along the length of the glulam 100. In FIG. 14 and throughout this disclosure, the term glazing sealant refers to a sealant that provides a weather barrier, adhesive properties, and shear strength, sufficient to stabilize and hold the glass panel 125 for the particular application and as required by local building codes. In applications where the glass panel 125 requires greater sheer strength, a structural glazing sealant can be used. The term structural glazing sealants is a glazing industry term that refers to sealants that provide weather barrier against air and moisture and provide structural support and attachment of glass panels 125 and other components of the structural glazing system in accordance with glazing industry defined standards. The glazing sealants 127 in FIG. 14 can be made of a high-strength elastomeric sealant, for example structural silicone or alternatively, a non-structural silicone with sufficient shear structure for the particular application as defined by local building codes or by industry standards. While the glazing sealant 127 is often in the form of silicone, other glazing materials can be utilized, such as structural glazing tape, in accordance with local building codes and engineering load and wind stress requirements. The setting blocks 129 can be made from a material typically with 85±5 Shore A durometer, such as polychloroprene (neoprene), silicone, ethylene propylene diene monomer (EPDM). One skilled in the art of structural glazing will readily recognize other materials suitable for providing cushion for the glass and support the glass panel 125 with a dead load.

In FIGS. 15-16, the mounting structure of the removable glazing stops 119 is connected directly to the second longitudinal surface 131. The removable glazing stops 119 are illustrated with a flexible gasket 120 that engages the surface of the glass panel 125. The removable glazing stops 119 are illustrated as being made out of wood. However, they may be made out of other rigid materials such as aluminum. The choice of material can depends on several factors. These can include aesthetic appearance, thermal performance (i.e. heat transfer, desired coefficient of thermal expansion or other thermal parameters), strength, or manufacturing considerations. In FIG. 15 the glass panel 125 is held above the second longitudinal surface 131 by setting blocks 129 and the removable glazing stops 119. In FIG. 16, the glass panel 125 is held above the second longitudinal surface 131 by setting blocks 129, a removable glazing stop 119 on one side of the glass panel 125, and a combination of the second outer lam 107 and glazing sealant 127 on the other side of the glass panel 125. Here is the second outer lam 107 is wider than the first outer lam 101 and the core lam 109. In FIG. 17, the outward facing side (i.e. into the outside environment) of the glass panels 125 are held to glulam 100 by a pressure bar assembly 135 and flexible gaskets 120 attached to the pressure bar assembly 135. The inside surface (i.e. the side facing the interior environment) of the glass panel 125 is held against flexible gaskets 120 attached to mounting base 137. The mounting base 137 is shown inset with the glulam assembly so that is it approximately flush with the second longitudinal surface 131. The pressure bar assembly 135 is shown being secured to the mounting base 137 by a threaded fastener 139. The illustrated arrangement obscures the lamination seams on the second longitudinal surface 131. In addition, because in FIG. 17 the glulam is being utilized as a vertical mullion, both ends of the glulam 100 will likely not be seen.

Figure 18:
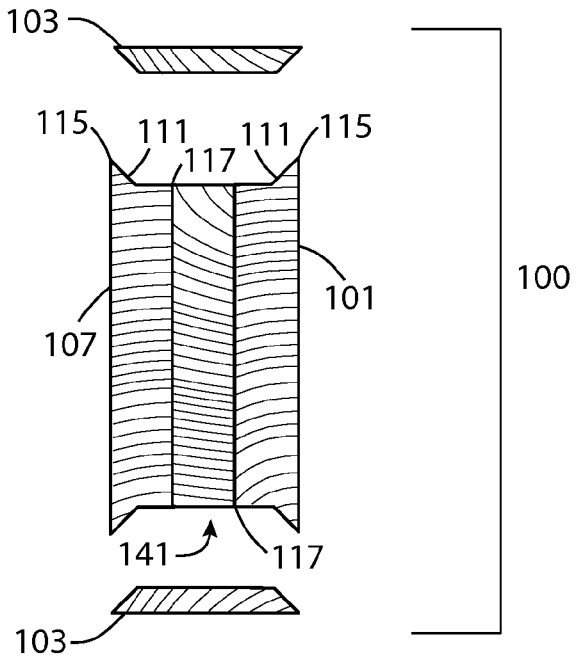
FIG. 18 illustrates left end exploded view a glue-laminated timber of the present disclosure that includes no end caps.
Figure 19:
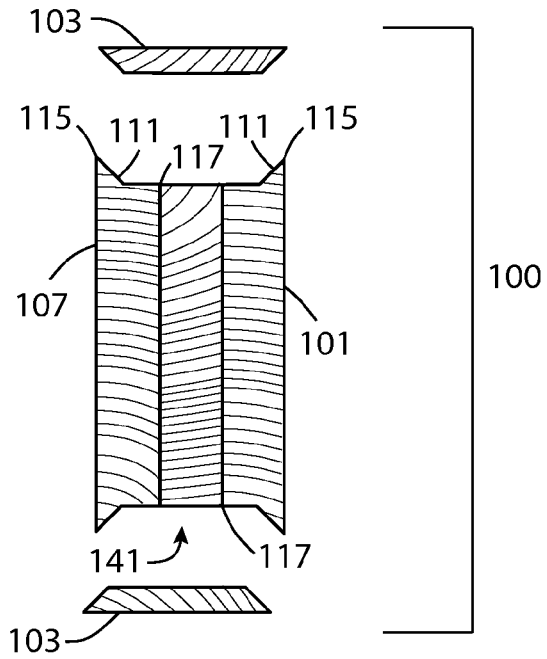
FIG. 19 illustrates right end exploded view a glue-laminated timber of FIG. 18.

FIGS. 18-19 illustrate an alternative example of the glulam 100 of the present disclosure where the lamination seams 117 are covered on both opposing seam laminated faces. The first outer lam 101 and the second outer lam 107 each are illustrated with the bevels 111 running longitudinally to receive the complementary beveled surface of the solid wood longitudinal caps 103. The complementary beveled surface of the solid wood longitudinal caps 103 and the inset portions 141 are so shaped that they form a seamless joint along the longitudinal edges 115 or margins. The glulam 100 of FIGS. 18-19 would appear on four side surfaces (i.e. the outer surfaces of the solid wood end caps 105 and the outer surfaces of the first outer lam 101 and the second outer lam 107) to be a solid piece of saw cut lumber, without seams or laminations.

The inventor built a glulam 100 of the present disclosure similar to FIGS. 18-19, except with a four-lam layup instead of a three-lam layup. The glulam 100 was tested at an independent test laboratory (Intertek-ATI) and compared to several standard glulams. The glulam 100 for the test was fabricated out of white oak, and was characterized as have three vertical lamination joints and two horizontal lamination joints and a nominal width of 8 inches (0.20 m). Table I shows the glulam 100, marked as "Novel Glulam," compared to two standard glulams also made out of white oak indicated as "Std. A" and "Std. B." Std. A and Std. B are abbreviations for Standard Glulam A and Standard Glulam B, respectively. Std. A Specimen A had a nominal width of 8.25 inches (0.21 m) with ten laminations. Standard Specimen B has a nominal width of 8.875 inches (0.23 m) with eleven laminations. The tests shown in Table I were performed in accordance with ASTM D 198-09 Standard Test Methods of Static Tests of Lumber in Structural Sizes, AITC Test T110-2007 Cyclic Delamination Test, and AITC Test T119-2007 Full Size End Joint Tension Test.

The "novel glulam" outperformed both standard glulams for three out of the four tests shown in Table I. Most significantly, the y-y average maximum load strength shows a 37% improvement over the standard glulams. These results were unexpected and go against "conventional wisdom" concerning glulam construction.

TABLE 1

| Test Description | Novel Glulam | Standard Glulam A | Standard Glulam B |
|---|---|---|---|
| Avg. Modulus of Elasticity Ey-y: psi (kPa) | 2,026,667 ($13.9 \times 10^6$) | 2,013,333 ($13.8 \times 10^6$) | 2,156,666 ($14.9 \times 10^6$) |
| Avg. Max. Load yy: lbf (N) | 12,374 (55,042) | 9,034 | 8,236 |
| Avg. Modulus of Elasticity Ex-x: psi (kPa) | 2,392,138 ($16.5 \times 10^6$) | 2,295,776 ($15.8 \times 10^6$) | 2,383,517 ($16.4 \times 10^6$) |
| Avg. Max. Load xx: lbf (N) | 15,064 (67,008) | 14,762 (65,664) | 13,735 (61,096) |
| Average Delamination % | 7.5 | 22 | 15 |

Figure 20:
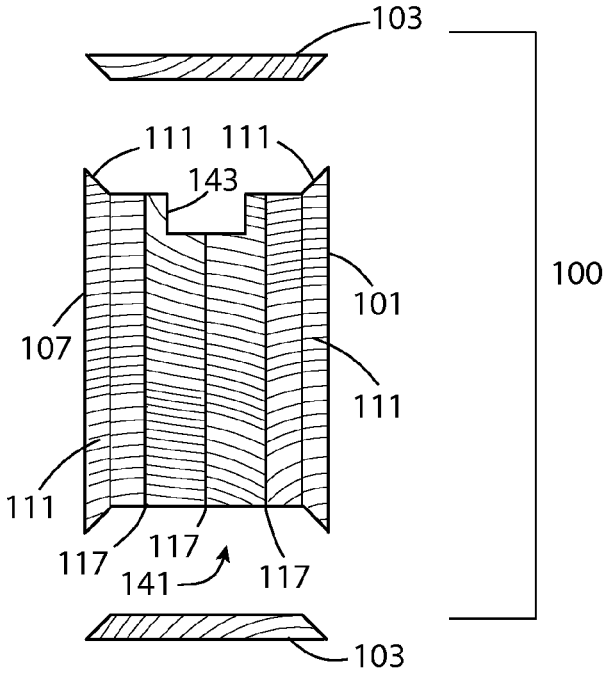
FIG. 20 illustrates left end exploded view a glue-laminated timber of the present disclosure that includes two end caps and a wire-channel with the end cap moved out of view for clarity.
Figure 21:
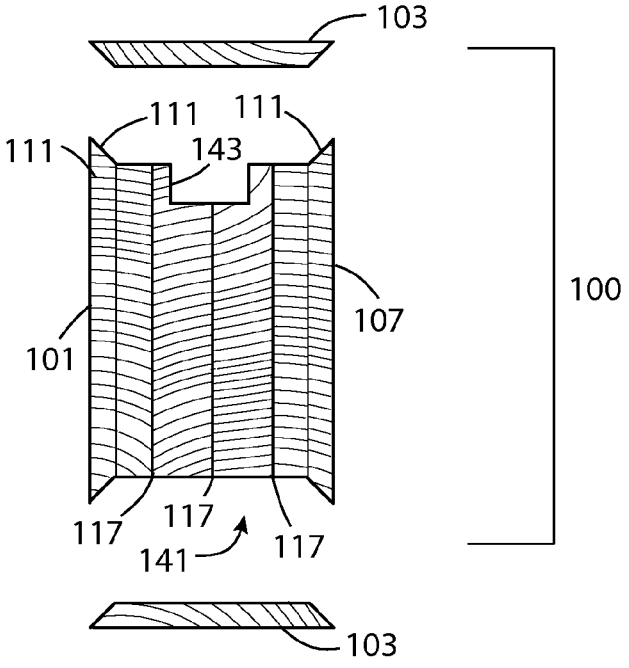
FIG. 21 illustrates right end exploded view a glue laminated timber of the FIG. 20 with the end cap moved out of view for clarity.
Figure 22:
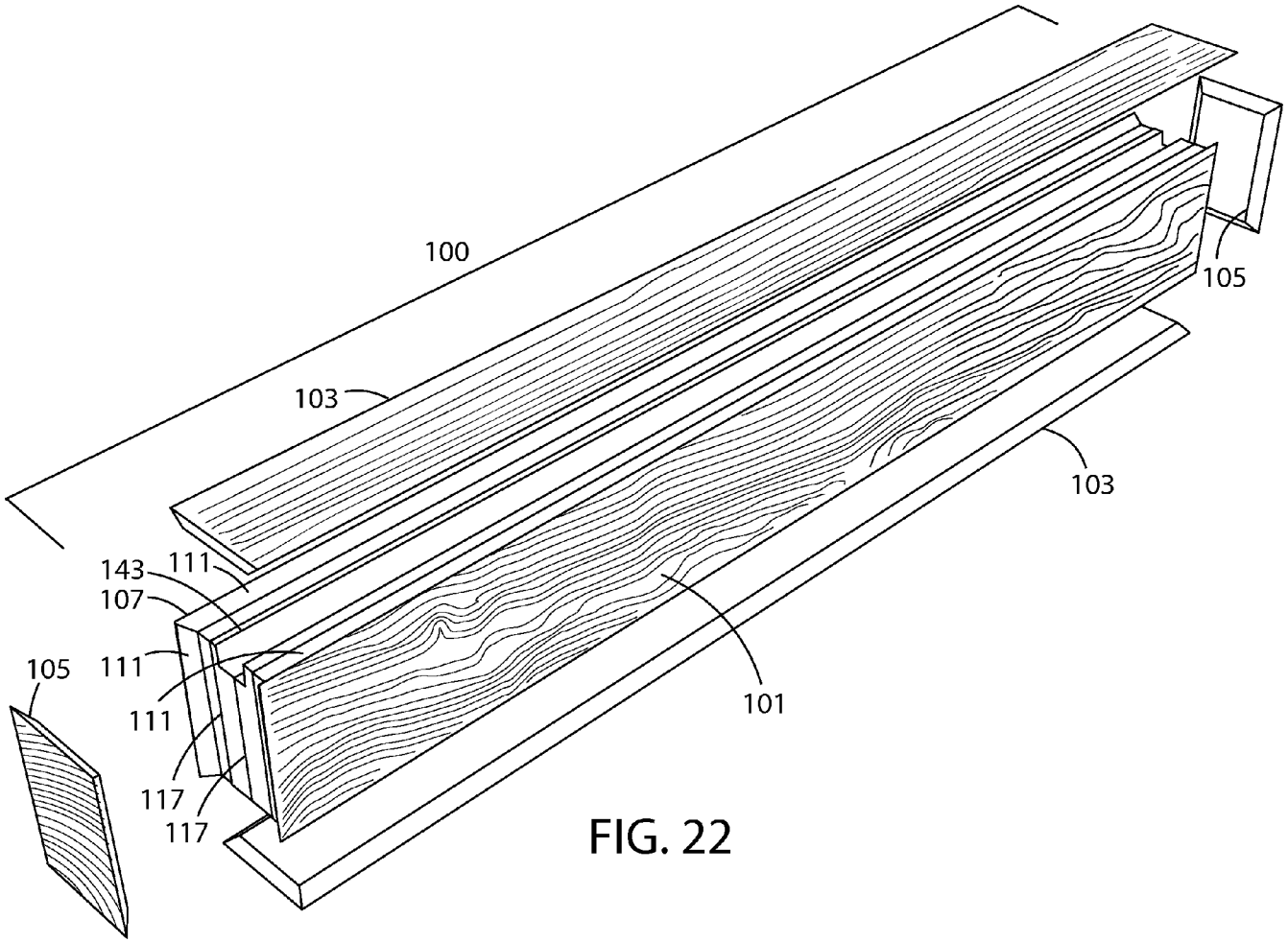
FIG. 22 illustrates a top and front perspective exploded view of an alternative glue-laminated timber of FIGS. 20-21.

FIGS. 20-22 illustrate an alternative example of the glulam 100 of the present disclosure where the lamination seams 117 are fully covered on all sides. FIG. 20 illustrates left end and FIG. 21 the right end of with the end caps moved out of view for clarity. FIG. 22 is a top and front perspective view of FIGS. 20 and 21, where the lamination seams 117 are fully covered by a pair of solid wood longitudinal caps 103 and a pair of solid wood end caps 105. FIGS. 20-21 show the pair of solid wood longitudinal caps 103 that are received and seated full against the sides and bottom of inset portions 141 of the glulam 100. In FIGS. 20-22, a wire chase 143 is illustrated as grooved into the surface of one of bottom surfaces of the inset portion 141 along the length of glulam 100. The first outer lam 101 and the second outer lam 107 each are illustrated with the bevels 111 running longitudinally to receive the complementary beveled surface of the solid wood longitudinal cap 103. The first outer lam 101 and the second outer lam 107 each are illustrated with bevels running transverse to their length (vertically in the figures). These bevels are shaped to receive the complementary beveled surface of the solid wood end caps 105.

In addition to applications in the construction trade, such as doors, windows, and structural beams or columns, the glulam 100 of FIGS. 3-22 can also be used for wood working or furniture making. It is often difficult to obtain furniture grade wood in certain species, such as red wood or cypress in thickness over 8/4 (0.051 m). Often, it is difficult or cost prohibitive to get furniture grade exotic hard woods such as, east Indian rose wood, purple heart, poculi, or zebrawood, in thicknesses over 4/4 (0.025 m). The glulam of the present disclosure can allow the furniture maker or carpenter to realize greater thickness of furniture grade dimensioned lumber than normally practical. For such woods, a two-lam or three lam layup such as that shown in FIGS. 12-13 or FIGS. 18-19 can used as stock pieces with greater thicknesses than normally available with saw cut stock; for example, thicknesses of 8/4 (0.051 m) or 12/4 (0.076 m).

A novel glulam and several applications utilizing the novel glulam have been described. It is not the intent of this disclosure to limit the claimed invention to the examples, variations, and exemplary embodiments described in the specification. For example, while embodiments illustrating glulams with a layup of two outer lams and either one or two core lams where discussed, the claimed invention is not limited to those implementations. The same described principles can be applied to other layouts. Those skilled in the art will recognize that variations will occur when embodying the claimed invention in specific implementations and environments. For example, it is possible to implement certain features described in separate embodiments in combination within a single embodiment. Similarly, it is possible to implement certain features described in single embodiments either separately or in combination in multiple embodiments. It is the intent of the inventor that these variations fall within the scope of the claimed invention. While the examples, exemplary embodiments, and variations are helpful to those skilled in the art in understanding the claimed invention, it should be understood that, the scope of the claimed invention is defined solely by the following claims and their equivalents.

What is claimed is:

1. A glulam comprising:

a plurality of rectangular solid structural wood pieces laminated together to form a rectangular structure with opposing solid wood faces, opposing seam laminated faces longitudinally adjacent to the opposing solid wood faces, and opposing seam laminated ends transversely adjacent to the opposing seam laminated faces and the opposing solid wood faces;

a seam laminated face of the opposing seam laminated faces including an inset drafting directly inward from opposing edges along the seam laminated face and the opposing solid wood faces;

a solid wood cap extending longitudinally along the seam laminated face between the opposing seam laminated ends and including an outward facing surface; and the solid wood cap is aligned and laminated to the inset to form seamless joints along the opposing longitudinal edges with the outward facing surface and the opposing solid wood faces each forming continuous seamless surfaces.

2. The glulam of claim 1, wherein:

a first and second seam laminated face widths are narrower than a corresponding first and second solid wood face widths.

3. The glulam of claim 1, further comprising:

the seam laminated face is a first seam laminated face, the inset is a first inset, the solid wood cap is a first solid wood cap, and the outward facing surface is a first outward facing surface;

a second seam laminated face of the opposing seam laminated including a second inset drafting directly inward from opposing edges along the seam laminated face and the opposing solid wood faces;

a second solid wood cap extending longitudinally along the second seam laminated face between the opposing seam laminated ends and including a second outward facing surface; and the second solid wood cap is aligned and laminated to the second inset to form seamless joints along the opposing longitudinal edges with the second outward facing surface and the opposing solid wood faces each forming continuous seamless surfaces.

4. The glulam of claim 3, wherein:

a first and second seam laminated face widths are narrower than a corresponding first and second solid wood face widths.

5. The glulam of claim 3, further comprising:

a first end of the opposing seam laminated ends including a first end inset that drafts directly inward from and along corresponding first end edges of the opposing solid wood faces;

an end cap including an end cap outer surface; and the end cap and the first end so positioned and joined so that the first outward facing surface, the second outward facing surface, the opposing solid wood faces, and the end cap outer surface each forming continuous seamless surfaces.

6. The glulam of claim 1, further comprising:

a first end of the opposing seam laminated ends including a first end portion inset that drafts directly inward from and along corresponding first end edges of the opposing solid wood faces;

an end cap including an end cap outer surface; and the end cap and the first end so positioned and joined so that the outward facing surface, the opposing solid wood faces, and the end cap outer surface each forming continuous seamless surfaces.

7. The glulam of claim 6, wherein:

the end cap outer surface includes end grain pattern; and the outward facing surface and the opposing solid wood faces each include a longitudinal grain pattern.

8. The glulam of claim 1, wherein:

the outward facing surface and the opposing solid wood faces each include a longitudinal grain pattern.

9. A frame glazed structure, comprising:

a plurality of rectangular solid structural wood pieces laminated together to form a rectangular structure with opposing solid wood faces, opposing seam laminated faces longitudinally adjacent to the opposing solid wood faces, and opposing seam laminated ends transversely adjacent to the opposing seam laminated faces and the opposing solid wood faces;

a first seam laminated face of the opposing seam laminated faces including an inset drafting directly inward from opposing edges along the first seam laminated face and the opposing solid wood faces;

a solid wood cap extending longitudinally along the first seam laminated face between the opposing seam laminated ends and including an outward facing surface;

a second seam laminated face of the opposing seam laminated faces;

a glass panel projecting outward from the second seam laminated face; and the solid wood cap is aligned and laminated to the inset to form seamless joints along the opposing longitudinal edges with the outward facing surface and the opposing solid wood faces each forming continuous seamless surfaces.

10. The frame glazed structure of claim 9, further comprising:

a rectangular solid structural wood piece of the plurality of rectangular solid structural wood pieces;

the rectangular solid structural wood piece indented with respect to the plurality of rectangular solid structural wood pieces forming a groove extending longitudinally in the second seam laminated face;

a stop block seated within the groove;

a glazing sealant; and the glass panel seated against the stop block and secured within the groove by the glazing sealant.

11. The frame glazed structure of claim 9, further comprising:

a stop block seated on the second seam laminated face; and first and second rigid glazing stops removably secured to the second seam laminated face and positioned against opposing glazing surfaces of the glass panel with the glass panel seated against the stop block and secured to the second seam laminated face by the rigid glazing stops.

12. The frame glazed structure of claim 9, further comprising:

the a plurality of rectangular solid structural wood pieces and the solid wood cap oriented and positioned as an interior vertical mullion;

the glass panel includes an outward facing glazing surface and inward facing glazing surface;

a pressure bar base that is inset within and secured to the second seam laminated face and forming a planar surface therewith; and a pressure bar positioned against the outward facing glazing surface and secured to the pressure bar base.

13. The frame glazed structure of claim 9, further comprising:

a detent in the second seam laminated face extending from a first solid wood face of the opposing solid wood faces and forming an inside wall extending perpendicularly upward from the detent;

the glass panel includes a first glazing surface and a second glazing surface;

a rigid glazing stop removably secured to the detent and positioned against the first glazing surface;

a glazing sealant; and the second glazing surface secured to the inside wall by the glazing sealant.

14. The frame glazed structure of claim 9, wherein:

first and second seam laminated face widths are narrower than a corresponding first and second solid wood face widths.

15. The frame glazed structure of claim 14, further comprising:

a rectangular solid structural wood piece of the plurality of rectangular solid structural wood pieces;

the rectangular solid structural wood piece indented with respect to the plurality of rectangular solid structural wood pieces forming a groove extending longitudinally in the second seam laminated face;

a stop block seated within the groove; and the glass panel seated against the stop block and secured within the groove by a glazing sealant.

16. The frame glazed structure of claim 14, further comprising:

a stop block seated on the second seam laminated face; and first and second rigid glazing stop removably secured to the second seam laminated face and positioned against opposing glazing surfaces of the glass panel with the glass panel seated against the stop block and secured to the second seam laminated face by the rigid glazing stops.

17. The frame glazed structure of claim 14, further comprising:

the a plurality of rectangular solid structural wood pieces and the solid wood cap oriented and positioned as an interior vertical mullion;

the glass panel includes an outward facing glazing surface and inward facing glazing surface;

a pressure bar base that is inset within and secured to the second seam laminated face and forming a planar surface therewith; and a pressure bar positioned against the outward facing glazing surface and secured to the pressure bar base.

18. The frame glazed structure of claim 14, further comprising:

a detent in the second seam laminated face extending from a first solid wood face of the opposing solid wood faces and forming an inside wall extending perpendicularly upward from the detent;

the glass panel includes a first glazing surface and a second glazing surface;

a rigid glazing stop removably secured to the detent and positioned against the first glazing surface;

a glazing sealant; and the second glazing surface secured to the inside wall by the glazing sealant.

* * * * *